US006575008B1

(12) United States Patent
Huhtala

(10) Patent No.: US 6,575,008 B1
(45) Date of Patent: Jun. 10, 2003

(54) METHOD AND PIPE-BENDING DEVICE FOR MANUFACTURING A PIPE-OFFSET FOR A CONNECTOR

(76) Inventor: Tarmo Huhtala, Jaakkolantie 8, FIN-40950 Muurame (FI)

( * ) Notice: Subject to any disclaimer, the term of this patent is extended or adjusted under 35 U.S.C. 154(b) by 0 days.

(21) Appl. No.: 09/890,719

(22) PCT Filed: Feb. 10, 2000

(86) PCT No.: PCT/FI00/00093

§ 371 (c)(1),
(2), (4) Date: Aug. 1, 2001

(87) PCT Pub. No.: WO00/47345

PCT Pub. Date: Aug. 17, 2000

(30) Foreign Application Priority Data

Feb. 11, 1999 (FI) ..... 990271

(51) Int. Cl.[7] ..... B21D 7/022
(52) U.S. Cl. ..... 72/369; 72/415; 72/453.16
(58) Field of Search ..... 72/369, 380, 386, 72/389.7, 390.4, 390.5, 414, 415, 453.15, 453.16

(56) References Cited

U.S. PATENT DOCUMENTS 2,771,934 A * 11/1956 Payne
3,507,141 A * 4/1970 Fisher
4,232,542 A 11/1980 Caporusso et al.
4,942,757 A * 7/1990 Pecora
5,653,139 A 8/1997 Lee

FOREIGN PATENT DOCUMENTS

FR 889424 1/1944

* cited by examiner

*Primary Examiner*—Lowell A. Larson
(74) *Attorney, Agent, or Firm*—Fildes & Outland, P.C.

(57) ABSTRACT

A method and pipe-bending tool for manufacturing a pipe-offset for a connector at the end of a pipe, needed in the extension of the connector of the pipe of a pipe layer installed on a surface in which said pipe-offset for the connector, i.e. two consecutive bends are manufactured close to the end of the pipe due to the need of space of the connector, in order to move the end of the pipe in parallel to a certain distance from the level of the pipe layer. The bends are produced by placing the pipe between two lasts of a handheld tool, which are pressed against each other with the help of an operating device and in which there exists a pipe-offset of the connector, i.e. forms equal to both bends. The lasts are able to turn at least in a limited manner around the axle in the direction of the pressure, whereby the lasts can easily be turned in the direction of the pipe.

10 Claims, 3 Drawing Sheets

METHOD AND PIPE-BENDING DEVICE FOR MANUFACTURING A PIPE-OFFSET FOR A CONNECTOR

TECHNICAL FIELD

The invention relates to a method and pipe-bending device for manufacturing a pipe-offset for a connector at the end of a pipe, needed in the extension of the connector of a pipe of a pipe layer installed on a surface, for example on the wall, in which said pipe-offset for the connector, i.e. two consecutive bends, are manufactured close to the end of the pipe due to the need of room of the connector, in order to move the end of the pipe in parallel to a certain distance from the level of the pipe layer, and in which the bends are achieved by placing the pipe between two lasts, which are pressed against each other with the help of an operating device and in which there is a pipe-offset of the connector, i.e. forms equal to both bends.

BACKGROUND OF THE INVENTION

Different types of pipe lines are installed in the industry to be used in pneumatic, hydraulic and lubrication systems. The pipes are usually installed next to each other as a neat pipe layer when the targets are in the same direction. It becomes necessary especially in connection with the renewal of apparatus to make pipe extensions with the help of pipe connectors, which do not in any way fit inside the thick pipe layer but the pipe that is fitted with the connector need therefore be fitted with a pipe-offset for the connector, i.e. the pipe must be bent outwards from the level of the pipe layer. Two consecutive bends are needed, by which the end of the pipe is moved outwards in parallel from the level of the pipe layer. In case such joints are needed for pipes that are situated next to each other, they are usually made by overlapping three pipe extensions at a distance from each other in the longitudinal direction, whereby the fourth pipe connector can again be on the same line with the first one.

Nowadays there has not been any suitable tool for manufacturing the pipe-offset for a connector at the place of installation and it has been necessary to remove the pipe in its entirety in order to fix it in a vice or in an pipe-bending tool that is otherwise in a fixed position. Two people have often been needed for bending a pipe. Lasts for manufacturing a pipe-offset have been in use before as such, but only in fixed pipe-bending machines. The installation work at the place of rebuilding has been rather difficult and slow, because it has been necessary to remove each pipe from its surface or to fit the pipe-offset for the connector to the previous installation. Rather little force is needed in the bending of the pipes that are less than 10 mm as to their diameter, but a hydraulic cylinder is probably the only possibility for an operating device in the bending of pipes of already 15 mm or more.

Portable pipe-bending devices are known as such, but they are not suitable for manufacturing a pipe-offset for a connector, because the force needed is essentially greater than that of a pipe of corresponding measurements in the making of one bend.

SUMMARY OF THE INVENTION

The object of this invention is to achieve a method for producing pipe-offsets for connectors that makes the installation work easier and a corresponding pipe-bending tool. A method for manufacturing a pipe-offset for a connector at the end of a pipe, needed in the extension of the connector of the pipe of a pipe layer installed on a surface, for example on the wall, in which said pipe-offset for the connector, i.e. two consecutive bends are manufactured close to the end of the pipe due to the need of space of the connector, in order to move the end of the pipe in parallel to a certain distance from the level of the pipe layer, and in which the bends are produced by placing the pipe between two lasts, which are pressed against each other with the help of an operating device and in which lasts there are the forms equal to the pipe-offset of the connector, i.e. both bends, characterized in that a portable, hand-carried tool is provided, which tool includes the said lasts and an operating device and by forming the lasts to be at least in a limited manner rotatable around the axle that is in the direction of the pressure, and that the pipe is supported in such a manner that its end may be bent flexibly at a certain distance from the surface and the tool is used directly at the place of installation of the extension of the connector and by turning the lasts in the direction of the pipe in such a manner that it can be placed between these.

A portable hand tool to manufacture the pipe-offset of a connector in a pipe for the extension of the connector, for example in the pipe of a pipe layer installed on the wall, in which said pipe-offset for the connector, i.e. two consecutive bends are manufactured close to the end of the pipe due to the need of space of the connector, in order to move the end of the pipe in parallel to a certain distance from the level of the pipe layer, which tool includes a frame, an operating device, steering devices in order to steer the power supply to the operating device, two opposite lasts including the forms of the pipe-offset for the connector, one of which is to be used by the operating device for linear movement, and the other being placed in a fixed manner against the linear movement, and in which case the straight pipe fixed between the lasts that are set open is arranged to be bent in the form regulated by the lasts by pressing one against the other on the operating device, characterized in that the tool has a handle in its frame and the operating device is fitted onto the external power supply or to function with the battery that belongs to the tool, and that there is at least one guide and a slide on the guide for supporting the moving last. According to the most profitable form of application the lasts are installed to the auxiliary frame, which is able to turn at least in a limited manner, most profitably all the way around, whereby the hand-hold of the device can be essentially the same notwithstanding the direction of the pipe lines that are to be installed. An ergonomic work approach requires that the handhold cannot turn into a difficult direction. According to one profitable form of application the steering apparatus of the operating device, for example an electric switch, are fixed to the handle, but a foot switch is also possible. The operating device is most profitaably a hydraulic cylinder, by which the necessary force is achieved for the thick pipes, but even battery operated operating devices equipped with conveyor screws can come into question especially in case of smaller pipes. The pressurized hydraulic oil needed by the hydraulic cylinder is produced by a hydraulic apparatus, which is connected to a tool according to the invention by connection leads of the necessary length. Instead of hydraulic machines it is possible to use devices that are correspondingly pneumatic. The operations of the hydraulic and pneumatic apparatus are steered by the operating devices for example with the help of an electric cable connection.

According to one profitable form of application, the fixed last is supported from the end of the guides of the moving last. Supporting bars situated underneath the lasts are profitably also used, whereby stiffness is achieved by the structure at the same time that the lasts are still open from the top. In order to bend the thick pipes an auxiliary pipe that is installed on top of the lasts may be profitably used, which effectively stiffens the auxiliary frame and the end part that is connected to it.

The other application forms and advantages of the invention are presented later in connection with the application examples, which are presented in the adjoining figures.

DETAILED DESCRIPTION OF THE INVENTION

Figure 1:
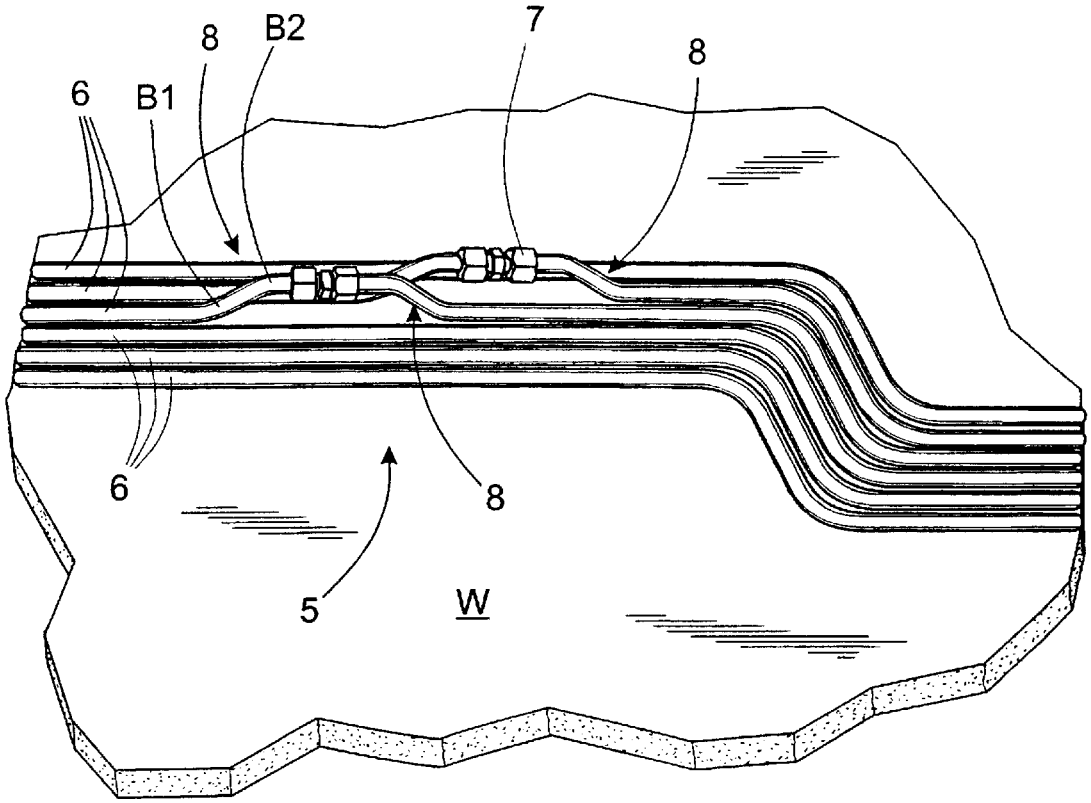
FIG. 1 presents the pipe layer formed by a piping installed on the wall, in which there are two connectors that are brought outwards with the help of pipe-offsets for the connectors.

According to FIG. 1, a piping is installed on wall W, forming a pipe layer 5, i.e. the separate pipes 6 are essentially on the same level. For the installation of connectors 7 it is necessary to bend the pipes that are to be continued outwards lo from the level with the help of pipe-offsets 8 for the connectors. These include two consecutive bends, which have been marked by references B1 and B2 in the figure. With the help of these, the end of the pipe is bent in parallel at a distance from the level of pipe layer 5, whereby connector 7 fits into the longitudinal line of the pipe.

In the pipe-bending tool according to the invention there is a frame 10 equipped with a handle 11 and a auxiliary frame 30 arranged to turn in relation to the frame. The auxiliary frame supports the pairs of lasts 12 and 13, FIG. 2. Here the operating device 16, i.e. the hydraulic cylinder, forms the frame 10 of the tool. The hydraulic cylinder has a drum part 17, a piston driver 18 with its pistons 19 and the end 22 of the cylinder, through which the piston driver comes out from the cylinder. The drum part 17 forms the axle of auxiliary frame 30 and is arranged in a rotating manner between the flange and auxiliary flange 23 of the hood 22. Auxiliary flange 23 is welded onto the cylinder drum. The handle 11 contains operating devices 29, here an electric switch, whereby the operations of the hydraulic apparatus (not shown) are steered. The hydraulic apparatus is attached with the help of pressurized oil hoses to the joints 20 and 21 of the tool. In addition to this, the electric switch is connected to the operating system of the hydraulic apparatus, whereby oil can be fed onto the chosen side of piston 19 with the help of the electric switch.

Figure 2:
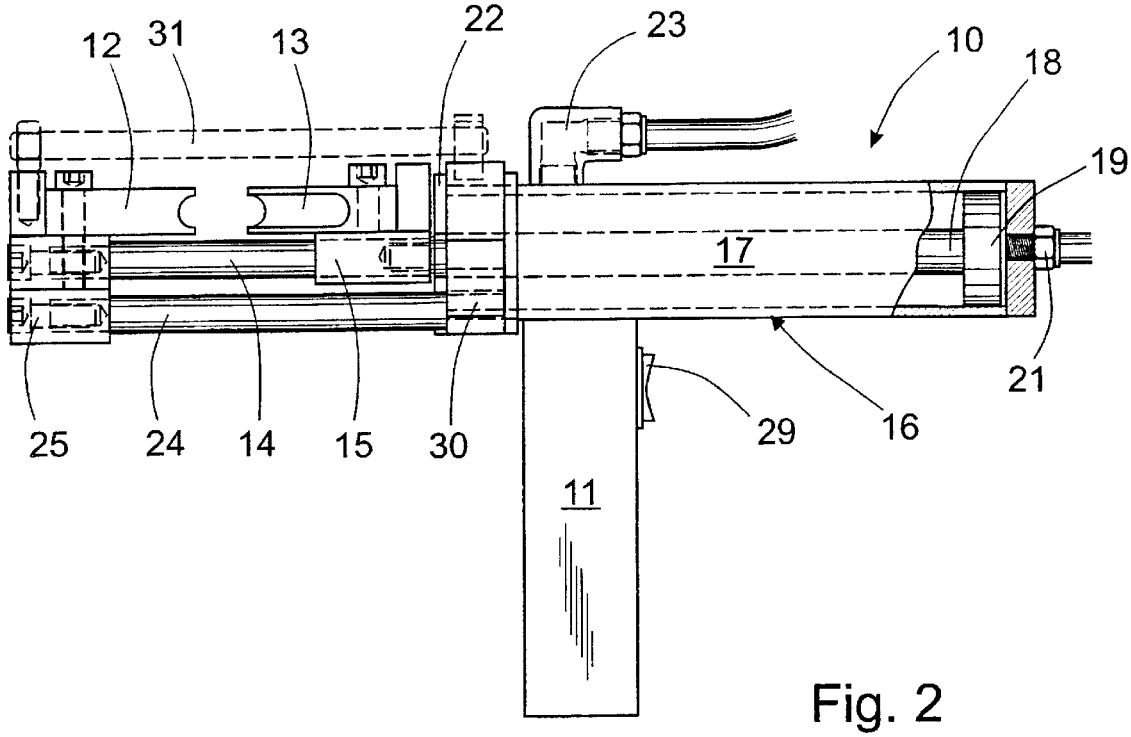
FIG. 2 presents a pipe-bending tool according to the invention seen from the side with the lasts installed horizontally.

Auxiliary frame 30 supports the end part 25 with the help of guide 14 and supporting bar 24. In the lighter models no support bar is needed at all, because guide 14 is sufficient to carry the end part. In the bending of thick pipes, the auxiliary frame is correspondingly equipped with an auxiliary support 31 fitted onto the lasts, which stiffens the auxiliary frame to an essential degree. However, the gap between lasts 12, 13 closes in the latter case from the top and the pipe must be pushed sideways to the gap. FIG. 2 does not show the limiter 26, the operations of which are explained in connection with FIG. 3.

Figure 3:
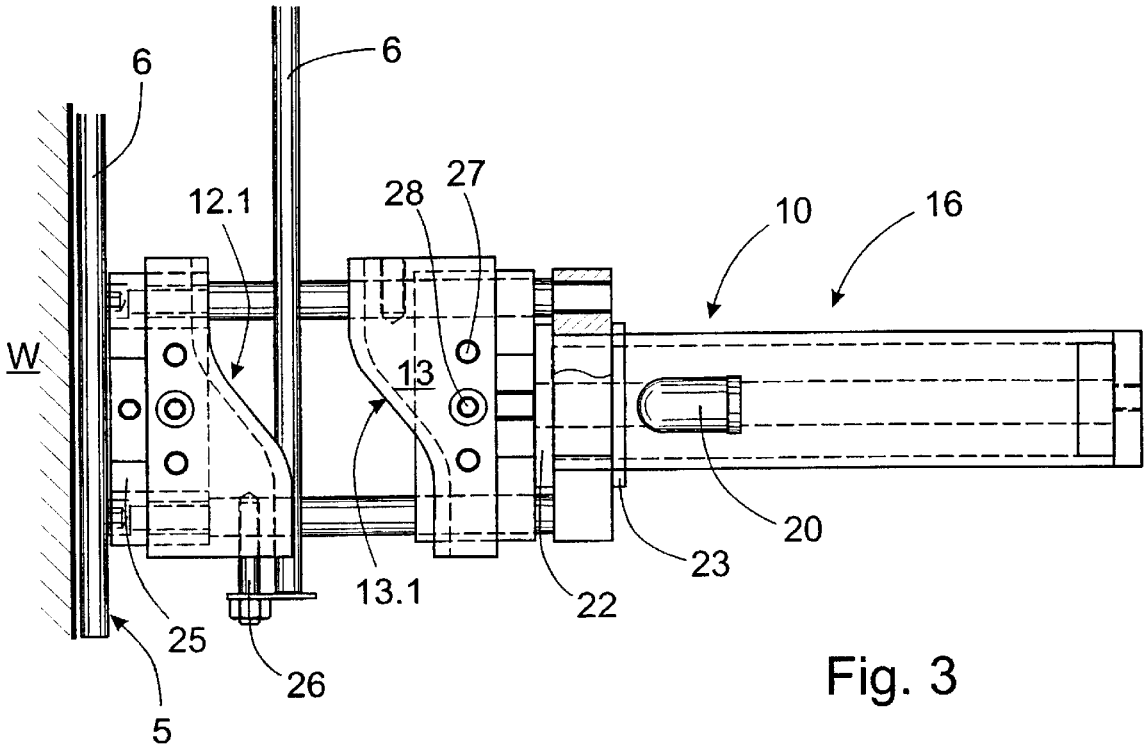
FIG. 3 shows the tool of FIG. 2 seen from above.

The tool is placed against the pipe layer 5 at the place of installation in accordance with FIG. 3 and the pipe that is to be treated is set into the gap between lasts 12 and 13. The fixed last 12 includes here a limiter 26, against which pipe 6 is placed and with the help of which the pipe-offset for the connector is manufactured at a point specially chosen in relation to the end of the pipe. In the situation shown in the figure, the last is first driven onto the pipe, after which its position is checked and the pressing takes place.

There is a pair of lasts for each pipe size (the normal range being 6—18 mm) and the lasts can be quickly changed, because they are supported mainly with the help of pegs 27 both from the slide 15 and the end part 25. In addition to this, they are locked with Teflon coated screws 28, which can be screwed down and unscrewed by hand.

Figure 4:
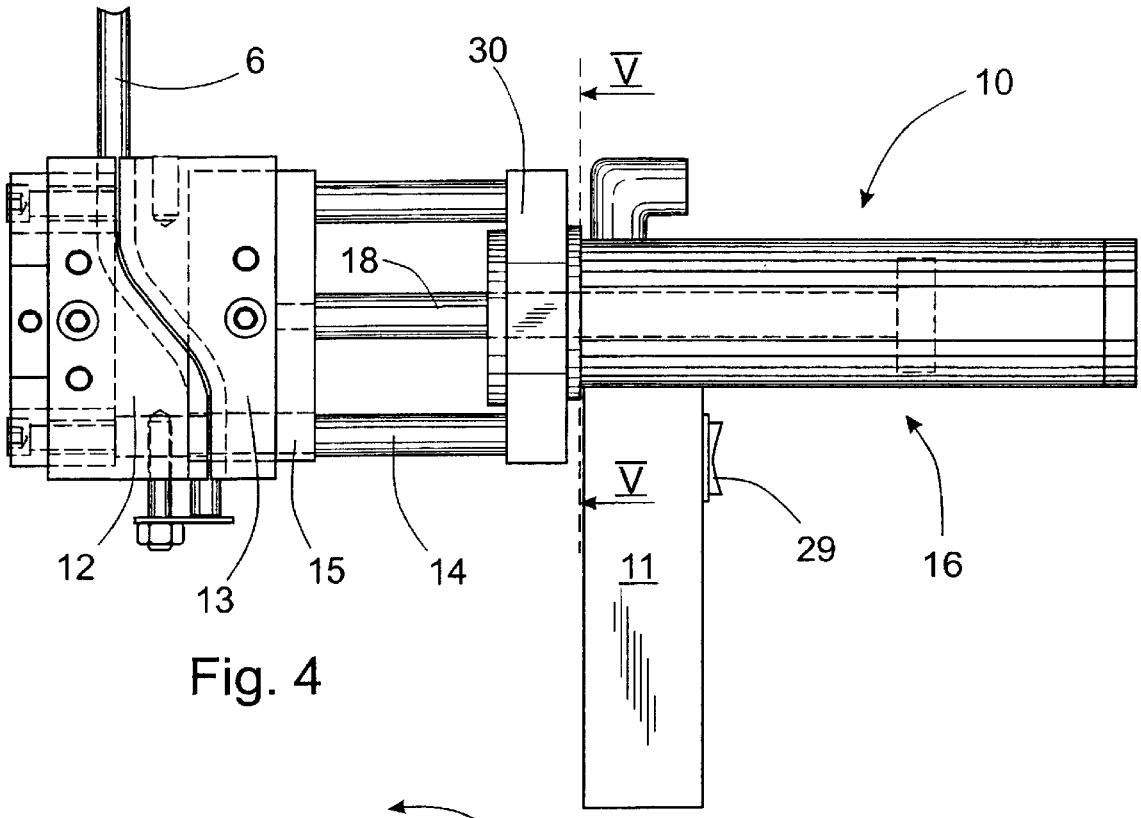
FIG. 4 presents the tool seen from the side, manufacturing a pipe-offset for a connector to a vertical pipe

FIG. 4 shows a situation in which the vertical pipe 6 has already been shaped and the pipe-offset for the connector is ready. Here the auxiliary frame 30 is turned 90 degrees in relation to FIGS. 2 and 3. After the pressing the (operating device) apparatus is steered with the help of switch 29 to pull the moving last 13 backwards with the help of slide 15, whereby the gap opens and the pipe-offset for the connector that is ready can be taken out from the gap.

Figure 5:
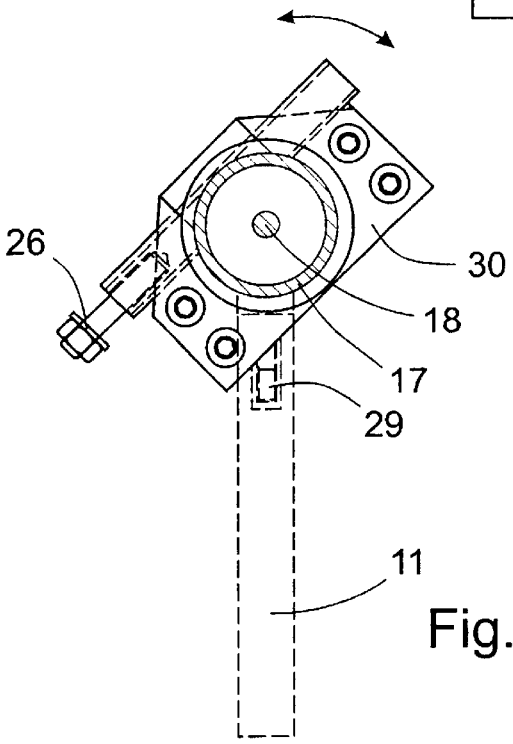
FIG. 5 presents the tool seen from behind with the lasts turned into a 45° angle.

FIG. 5 presents the cross section of FIG. 4 from point V—V, but with the auxiliary frame 30 turned into about 45° angle. Piston driver 18 is attached with a wire-wrap to slide 15. In addition to the fact that the auxiliary frame can be turned around in a rotating manner, limiter 26 can be installed on the chosen side of the tool, i.e. in the chosen last. The lasts can also be turned 180° in their own place (whereby there is no need to change the limiter).

If necessary, a protecting hood can be fitted as a finger protector underneath the slide.

Instead of the hydraulic cylinder used in the above example a pneumatic cylinder or battery operated screw turner can be used, especially in the case of smaller pipes, whereby outer power supply is not needed at all. Besides its great power, the advantage of a hydraulic cylinder is its good controllability.

With the help of the invention, one person can easily make the pipe-offsets for a connector, also to a separate pipe.

With a hydraulic apparatus with a pressure of 200 bars a power of 25 kN is achieved to a piston with a diameter of 40 mm. This is enough to bend rather thick pipes (with a diameter of 18 mm). In order to lower the pressure, the lasts and the clip plate of the fixed last can be produced from aluminium. In case bronze bushings are used in the slide, also the latter can be manufactured out of aluminium. On the other hand, it is possible to harden the gliding surfaces of the steel guides and the slide in order to simplify the structure.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A method for manufacturing a pipe-offset for a connector at the end of a pipe, in an extension of the connector of the pipe of a pipe layer installed on a surface in which said pipe-offset for the connector comprises two consecutive bends manufactured close to the end of the pipe due to the need of space of the connector, in order to move the end of the pipe in parallel to a certain distance from the level of the pipe layer, and in which the bends are produced by placing the pipe between two lasts, which are pressed against each other with the help of an operating device and in which lasts there are forms equal to the pipe-offset of the connector at both bends, characterized in that a portable, hand-carried tool is provided, which tool includes the said lasts and an operating device and by forming the lasts to be at least rotatable around an axle that is in a direction of applied pressure, and that the pipe is supported in such a manner that its end may be bent flexibly at a certain distance from the surface and the tool is used directly at the place of installation of the extension of the connector and by turning the lasts in the direction of the pipe.

2. A portable hand tool to manufacture a pipe-offset of a connector in a pipe for the extension of the connector, in which said pipe-offset for the connector comprises two consecutive bends manufactured close to an end of the pipe due to the need of space of the connector, in order to move the end of the pipe in parallel to a certain distance from the level of a pipe layer, which tool includes a frame, an operating device, steering devices in order to steer a power supply to the operating device, two opposite lasts including forms of the pipe-offset for the connector, one of which is to be used by the operating device for linear movement, and the other being placed in a fixed manner against the linear movement, and in which case straight pipe fixed between the lasts that are set open is arranged to be bent in the form regulated by the lasts by pressing one against the other on the operating device, characterized in that the tool has a handle in its frame and the operating device is fitted onto the power supply associated with the tool, and that there is at least one guide and a slide on the guide for supporting the moving last.

3. A tool according to claim 2, characterized in that at least one last includes a limiter in order to install the end of a pipe installed crosswise to a point previously chosen.

4. A tool according to claim 2, characterized in that the operating device forms the frame of the tool and includes a thrust shank that uses the last and the tool includes an auxiliary frame that supports the lasts, which is rotatably supported from the frame around an axle set by the thrust shank.

5. A tool according to claim 2, characterized in that the operating devices are set onto the handle.

6. A tool according to claim 2, characterized in that the operating devices are set onto a foot switch.

7. A tool according to claim 2, characterized in that the fixed last is supported at least by one supporting bar in addition to the guides, the supporting bar being placed at a distance on an opposite side from a level of the guides in relation to the lasts.

8. A tool according to claim 2, characterized in that a protecting hood is fitted under the guides and the slide.

9. A tool according to claim 7, characterized in that an auxiliary support that supports the fixed slide in a detachable manner is arranged on top of the slides in order to stiffen the structure while bending.

10. A tool according to claim 2, characterized in that the lasts are installed to be supported by pegs and the tool includes a series of lasts with several pairs of lasts for pipes of a different thickness, the lasts of the pair of lasts of which are each arranged to be attached in a detachable manner.

* * * * *